United States Patent [19]

Nakasone

[11] Patent Number: 4,676,037

[45] Date of Patent: Jun. 30, 1987

[54] BUILDING AND METHOD OF CONSTRUCTION

[76] Inventor: Toshio Nakasone, 23, Takasago-cho, Takasaki-shi, Gunma-ken, Japan

[21] Appl. No.: 751,192

[22] Filed: Jul. 2, 1985

[51] Int. Cl.[4] ..... E04H 1/00

[52] U.S. Cl. ..... 52/236.3; 52/284; 52/745

[58] Field of Search ..... 52/234, 30, 73, 251, 52/236.3, 648, 264, 283, 284, 741, 745

[56] References Cited

U.S. PATENT DOCUMENTS

| | | | |
|---|---|---|---|
| 3,302,363 | 2/1967 | Frey | 52/73 |
| 4,071,988 | 2/1978 | Bowes | 52/236.3 X |
| 4,441,286 | 4/1984 | Skvaril | 52/236.3 X |

FOREIGN PATENT DOCUMENTS

| | | | |
|---|---|---|---|
| 922081 | 3/1973 | Canada | 52/73 |
| 877665 | 4/1953 | Fed. Rep. of Germany | 52/236 |
| 2702357 | 7/1978 | Fed. Rep. of Germany | 52/73 |
| 441705 | 1/1968 | Switzerland | 52/745 |
| 322099 | 11/1929 | United Kingdom | 52/741 |
| 1002780 | 8/1965 | United Kingdom | 52/236.3 |
| 663798 | 5/1979 | U.S.S.R. | 52/236.3 |

*Primary Examiner*—Carl D. Friedman
*Assistant Examiner*—Naoko N. Slack
*Attorney, Agent, or Firm*—James H. Tilberry

[57] ABSTRACT

A multi-storied building is provided in which a central load-bearing structural member is formed in the shape of a plurality of vertically spaced-apart, hollow squares to which floor and ceiling joists are attached. The floor and ceiling joists extend normally in cantilever fashion from all four sides of the structural member. The roof and side walls are attached to the outer ends of the floor and ceiling joists, and an elevator may be mounted within the hollow square of the structural member.

2 Claims, 9 Drawing Figures

BUILDING AND METHOD OF CONSTRUCTION

FIELD OF THE INVENTION

This invention relates to small milti-storied buildings suitable for dwelling or commercial purposes which can be factory prefabricated and assembled on the construction site.

DESCRIPTION OF THE PRIOR ART

Prior art multi-storied buildings are for the most part custom-built on the job site with standard size lumber such as 2"×4", 2"×6", 2"×8", and 2"×10" wooden structural members set on 16" centers. Buildings constructed in this manner are labor-intensive and time-consuming. To construct buildings of this type with steel or concrete frames is not cost-effective.

OBJECTS OF THE INVENTION

It is among the objects of this invention to provide a milti-storied building which can be constructed less expensively than custom-built buildings; which can be factory pre-cut and partially preassembled; which can be assembled into modules suitable for connecting to like modules; which provides a central vertical structural member to support the building floor and ceiling joists; which provides a central vertical structural member suitable for use as an elevator shaft; which provides a central vertrical structural member from which floor and ceiling joists are cantilevered; and which provides cantilevered floor and ceiling joists to which side walls and a roof are attached.

These and other objects and advantages will become apparent to those skilled in the art upon reading the following specification, drawings, and claims, in which:

GENERAL DESCRIPTION OF THE INVENTION

The invention provides means to construct a multi-level frame building having a structural load-bearing core module at its center adapted to support the floors and roof of the building and to provide an elevator well. Floor and ceiling joists are cantilevered from the core module to support the exterior walls and roof. In the preferred embodiment of the invention, the structural support members are made from high strength wooden beams. However, the same principles of construction may be applied to steel or concrete beams.

DETAILED DESCRIPTION OF THE INVENTION

Figure 2:
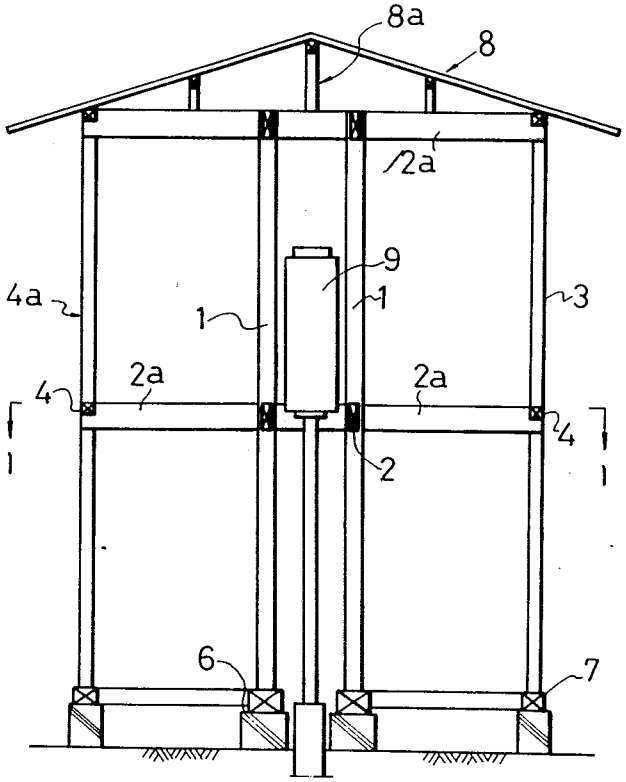
FIG. 2 is a partially sectioned, elevational view of the first embodiment of the invention.
Figure 1:
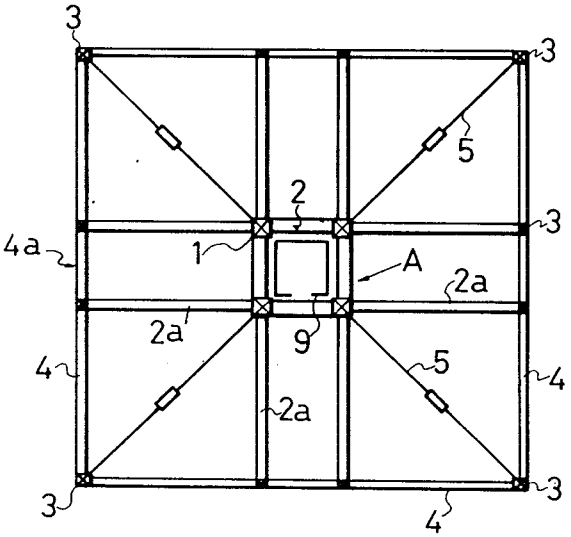
FIG. 1 is a partially sectioned plan view of a typical floor of a first preferred embodiment of this invention, taken along the line 1—1 of FIG. 2.
Figure 8:
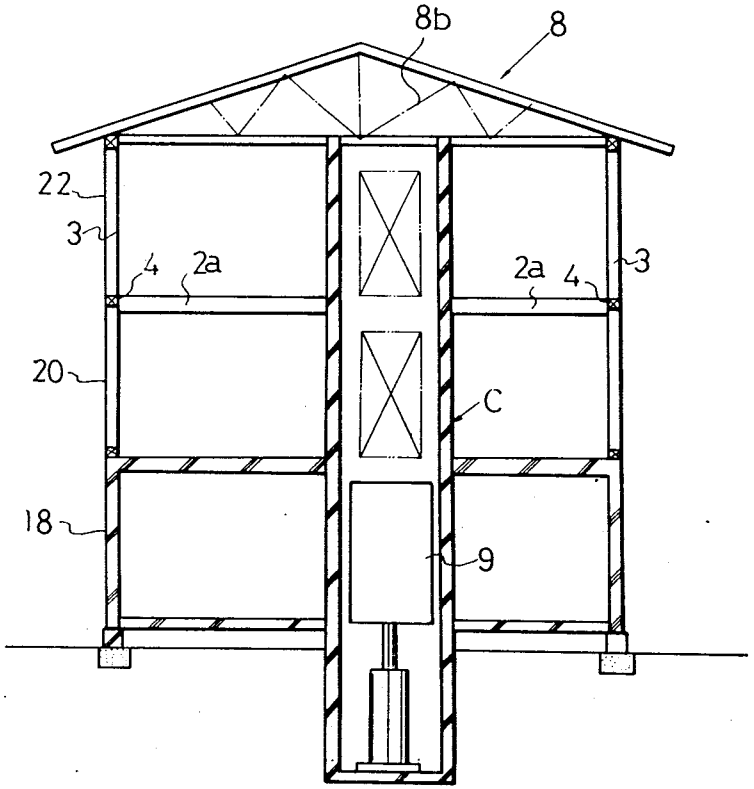
FIG. 8 is an elevational view of a fifth embodiment of the invention.

Referring first to FIGS. 1 and 2, therein is shown in a preferred embodiment of the invention a core module A comprising four vertical structural 8"×8" wooden timbers 1 arranged at the four corners of a 6'×6' hollow square. Timbers 1 are interconnected by horizontal 6"×10" beams 2. A core module A is provided for each floor of the building and each is aligned and stacked in tandem, one upon the other. In the alternative, in two-story buildings, each vertical timber 1 may extend in one piece from the ground floor level to the roof line. Horizontal floor-ceiling joists **2*a* are rigidly secured to core module A and extend outwardly therefrom to interconnect with vertical timbers 3 and horizontal timbers 4 which define the outer walls 4*a* of the building. For rigidity, diagonal tie rods 5 may be secured between the exterior corners of the core module A and the internal corners formed by the junction of vertical wall timbers 3 and horizontal wall timbers 4. The first floor of the building comprises floor joists 6 and base plates 7. The roof 8 may be supported by vertical trusses 8*a* (FIG. 2) or diagonal trusses 8*b* (FIG. 8). An elevator, such as the hydraulic elevator 9 of FIG. 2**, may be mounted to operate within the hollow square of core module A.

Figure 3:
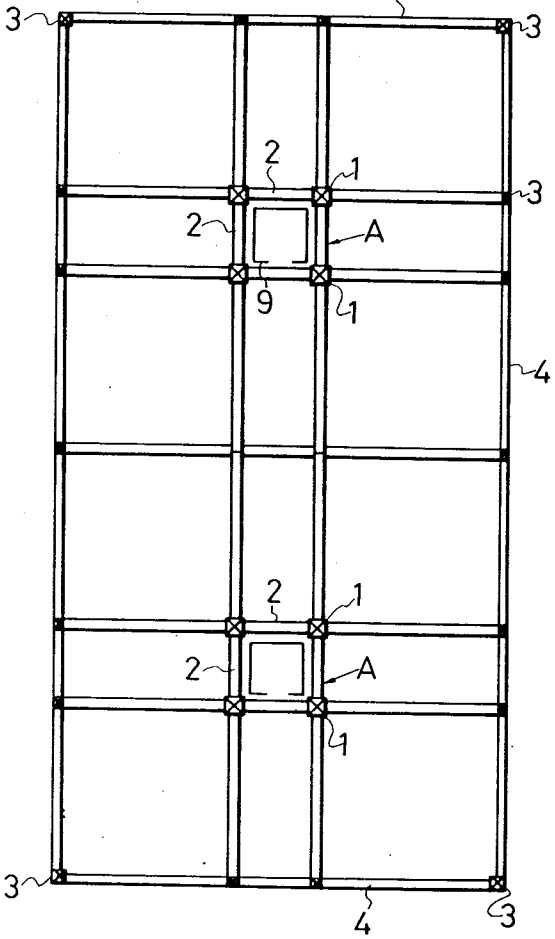
FIG. 3 is a plan view, similar to FIG. 1, of a second embodiment of the invention.

To increase the capacity of the building without adding additional levels, multiples of the floor plan of FIG. 1 may be joined as shown in FIG. 3.

Figure 4:
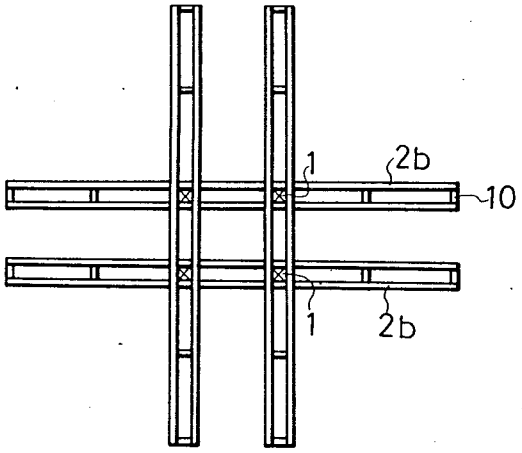
FIG. 4 is a typical plan view of a third embodiment of the invention, taken along the line 4—4 of FIG. 5.
Figure 5:
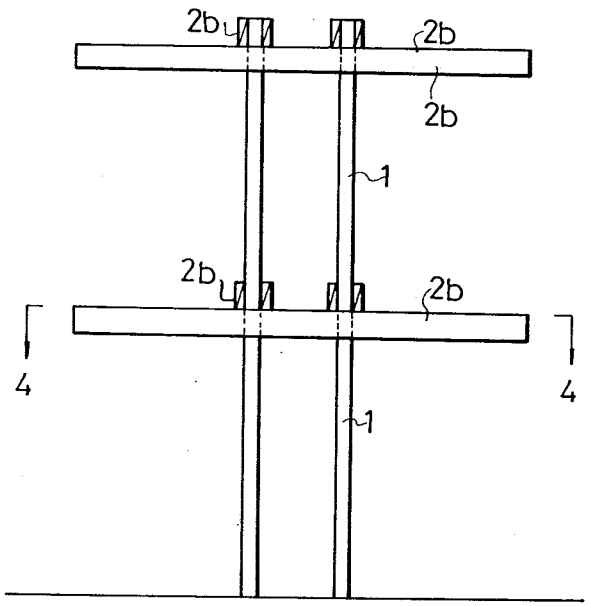
FIG. 5 is an elevational view of the structural members shown in plan in FIG. 4.

FIGS. 4 and 5 illustrate a different form of floor-ceiling joist **2*b* comprising pairs of thinner beams held apart and secured together by spacers 10. Joists 2*b* extend from side to side of the building and are cruciform, cross-lapped one above the other, as best shown in FIG. 5**.

Figure 6:
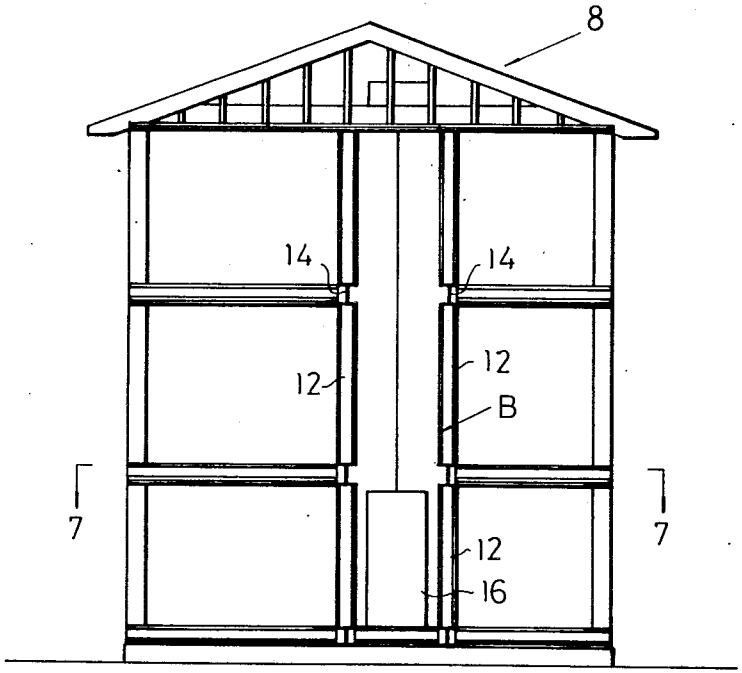
FIG. 6 is an elevational view of a fourth embodiment of the invention.
Figure 7:
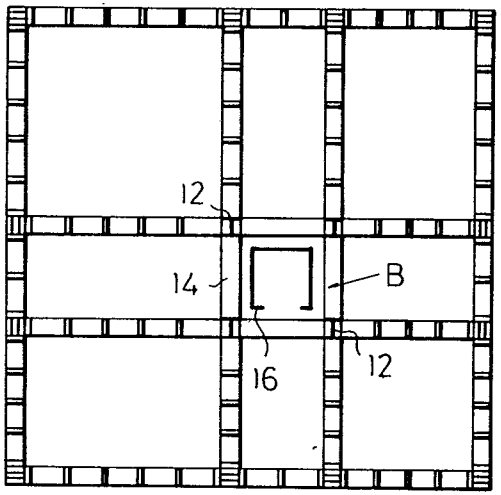
FIG. 7 is a typical plan view of the fourth embodiment of the invention, taken along the line 7—7 of FIG. 6.

FIGS. 6 and 7 illustrate a building in accordance with the invention in which the core module B, comprising vertical columns 12 and horizontal beams 14, is steel. A cable winding drum-type elevator 16 is shown mounted within core module B.

Referring now to FIG. 8, therein is shown a core module C of reinforced concrete. The first floor 18 is also fabricated from reinforced concrete, while the second floor 20 and the third floor 22 are fabricated in the same manner as shown and discussed with respect to FIGS. 1 and 2. Also as shown in FIG. 2, an hydraulic elevator 9 may be assembled to operate within core module C.

Figure 9:
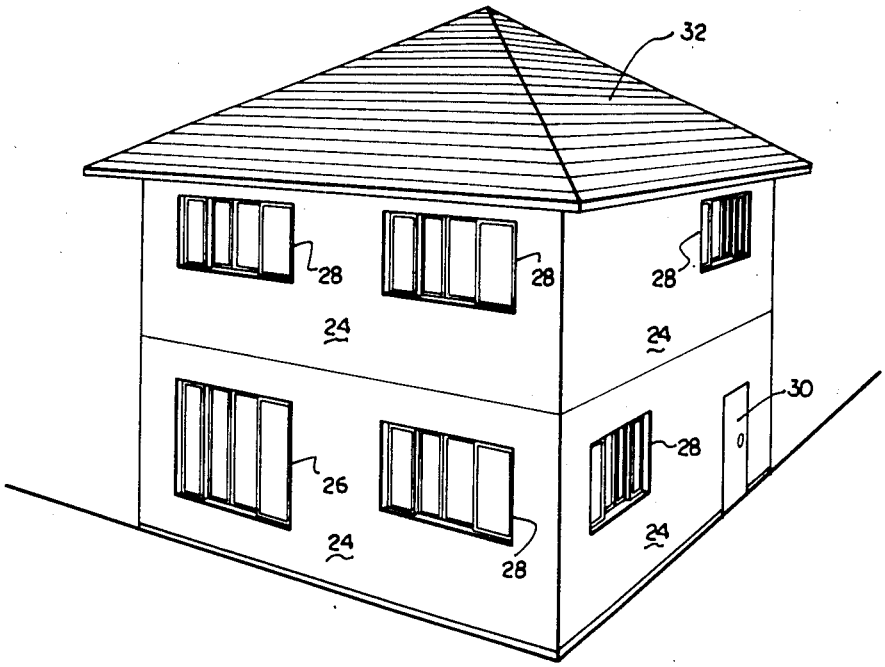
FIG. 9 is an elevational view in perspective of the first preferred embodiment of the invention showing the building as it would appear completed with siding and a hip roof.

FIG. 9 shows the first embodiment of the invention in its completed form having sidewall sheathing 24, windows 26 and 28, an entrance 30 and a hip roof 32.

In each of the embodiments of the invention shown and discussed, the core module adds strength, rigidity, and roof support to the building not otherwise obtainable by conventional methods of construction. When erecting the building, the core module is fabricated and set in place first. Thereafter, a crane is mounted on the core module for setting in place the vertical timbers 3 and horizontal timbers 4, 6, and 7 (FIG. 2), and wall and floor panels (not shown), until the building is completely erected, sheathed, and roofed.

The above-described embodiments of the invention are for the purpose of illustration only. Additional embodiments, modifications, and improvements can be readily anticipated by those skilled in the art after a reading and study of the present disclosure. Such additional embodiments, modifications, and improvements may be fairly presumed to be within the spirit , scope and purview of the invention as defined by the subtended claims.

What is claimed is:

1. The method of constructing a multi-storied framed building comprising the steps of:

(a) forming a plurality of cubical load bearing central structural core modules having four vertical sides;

(b) vertically stacking and securing said core modules one to another;

(c) securing a crane to the top of the uppermost of said core modules;

(d) crane lifting monolithic structural floor and ceiling beams into place against said four vertical sides of said core modules;

(e) permanently securing said monolithic structural floor and ceiling beams to said vertical sides of said core modules to be cantilevered horizontally outwardly in both directions from all of said four vertical sides of said structural core modules;

(f) crane lifting outer wall vertical structural beams into place and securing said structural vertical beams to the cantilevered opposite free ends of said monolithic structural floor and ceiling beams; and (g) lifting outer wall horizontal structural beams into place and securing said horizontal structural beams to the cantilevered opposite free ends of said structural floor and ceiling beams, whereby rooms are framed by said cantilevered monolithic structural floor and ceiling beams and said structural vertical and horizontal beams secured thereto and whereby said room structural frames are secured by said cantilevered structural floor and ceiling beams to all four vertical sides of said structural core modules and are vertically supported by said structural modules.

2. A multi-storied framed building comprising: a plurality of cubical central load-bearing vertically stacked and inter-secured structural core modules, each core module having four horizontal structural beams defining a hollow square structural form and four vertical structural beams secured to the four corners of said hollow square structural form to space one hollow square structural form vertically from another hollow square structural form; horizontal structural floor and ceiling joists fastened medially to the four sides of said hollow square structural forms and extending in cantilever fashion horizontally outwardly in both directions from said medial fastenings to said hollow square structural forms; exterior wall vertical structural beams secured to the free cantilevered ends of said floor and ceiling joists; exterior wall horizontal structural beams secured to the cantilevered free ends of said floor and ceiling joists; wall siding secured to said exterior vertical and horizontal beams.

* * * * *